United States Patent [19]

Van Der Heide et al.

[11] 4,246,440

[45] Jan. 20, 1981

[54] RADIO BROADCASTING SYSTEM WITH CODE SIGNALLING

[75] Inventors: Henri J. Van Der Heide, Hilversum; Johan M. Schmidt, Eindhoven, both of Netherlands

[73] Assignee: U.S. Philips Corporation, New York, N.Y.

[21] Appl. No.: 934,516

[22] Filed: Aug. 17, 1978

[30] Foreign Application Priority Data

Sep. 1, 1977 [NL] Netherlands ..... 7709619

[51] Int. Cl.[3] ..... H04H 5/00

[52] U.S. Cl. ..... 179/1 GD; 370/76; 375/67

[58] Field of Search ..... 179/1 GD, 1 GE, 15 BY; 325/36, 48, 64, 44, 320; 178/66 R, 67; 370/76; 375/67, 52

[56] References Cited

U.S. PATENT DOCUMENTS

| | | | |
|---|---|---|---|
| 3,242,431 | 3/1966 | Crafts | 325/320 |
| 3,478,169 | 11/1969 | Saito | 179/1 GD |
| 3,902,019 | 8/1975 | Bruene | 179/1 GE |
| 4,048,619 | 9/1977 | Forman et al. | 325/36 |

FOREIGN PATENT DOCUMENTS

| | | | |
|---|---|---|---|
| 2424112 | 11/1975 | Fed. Rep. of Germany | 179/1 GD |

*Primary Examiner*—Douglas W. Olms

*Attorney, Agent, or Firm*—Thomas A. Briody; William J. Streeter; Edward W. Goodman

[57] ABSTRACT

FM radio broadcasting is disclosed with code signalling by means of a subcarrier wave in the free frequency range around the stereo pilot on one side of said pilot (or of two subcarrier waves in said frequency range on both sides of the stereo pilot). The subcarrier wave, which is derived from the stereo pilot on the transmission side, is binary phase-modulated with the code signal, and is detected on the reception side with an unmodulated wave which is derived from the received stereo pilot.

9 Claims, 5 Drawing Figures

RADIO BROADCASTING SYSTEM WITH CODE SIGNALLING

BACKGROUND OF THE INVENTION

A. Field of the Invention

The invention relates to a radio broadcasting system with code signalling having a multiplex signal which is frequency modulated on a main carrier wave being transmitted at the transmission side, wherein the multiplex signal comprises: an audio frequency information signal; a stereo information signal modulated on a suppressed stereo subcarrier wave, a stereo pilot, whose frequency is situated between the frequency spectra of the audio frequency information signal and of the modulated stereo information signal and which serves for demodulating the stereo information signal, as well as a code signal which is binary phase-modulated on a further subcarrier wave which is a harmonic of a subharmonic of the stereo pilot, and which is derived from the same frequency source as the stereo pilot at the transmission side.

B. Description of the Prior Art

Such a radio broadcasting system with code signalling, which may for example be used for transmitter identification or for paging purposes or for the transmission of other kinds of information, has been described in Applicant's previous U.S. patent application Ser. No. 878,666, to which explicit reference is made. The system described in said Application exploys a subcarrier wave which is phase-modulated in binary manner with the transmitter identification signal (so-called P.S.K. signal), which subcarrier wave is situated above the frequency spectrum (23–53 KHz) of the modulated stereo information signal, for example with a subcarrier frequency 7/2 or of 16/5 times the stereo-pilot frequency (66.5 KHz or 60.8 KHz, respectively).

However, it has been found that, in the case of a transmission in accordance with said previously proposed system, disturbances in existing receivers are almost inevitable. The non-linear phase characteristic of the intermediate-frequency section of the receiver gives rise to interference products of the modulated transmitter identification signal with the other components of the multiplex signal, in particular the stereo pilot, and these interference products may become audible directly, or in the case of stereo reception via the stereo demodulation.

Furthermore, it has been found that in a number of stereo receivers, stereo detection is effected with not-sufficiently symmetrical 38 KHz signal. As a result of this the detection signal also contains a 76-KHz component, which in conjunction with the transmitter identification signal of for example 66.5 KHz, gives rise to an audible whistle tone.

SUMMARY OF THE INVENTION

It is the object of the invention to provide a radio broadcasting system with code signalling in which the above-mentioned disturbances are substantially avoided, while maintaining a reliable transmission of the code information. The radio broadcasting system in accordance with the invention is therefore characterized in that the subcarrier wave with the modulated code signal is situated in at least one of two halves of the frequency range, between the upper limit of the frequency spectrum of the audio-frequency information signal and the lower limit of the frequency spectrum of the modulated stereo information signal, which range is bisected by the stereo pilot.

The transmission in accordance with the invention has the following effects:

(1) Since the subcarrier wave for transmitter identification is now remote from the upper hamonics of the 38 KHZ stereo detection signal, these upper harmonics can no longer produce any audible interference in existing receivers.

(2) Since the subcarrier wave for transmitter identification is now situated much lower in the frequency spectrum of the multiplex signal, the signal/noise ratio is more favourable. Hence the modulated transmitter identification signal may have an even smaller amplitude than was the case with a subcarrier wave at, for example, 66.6 KHz. This may be illustrated by the fact that for a reliable code signalling with the present invention, the modulated code signal need only occupy approximately 0.25 KHz of the maximum frequency sweep of 75 KHz. In the case of a 66.5 KHz subcarrier wave this demands approximately 1 KHz. Obviously, the lower subcarrier amplitude substantially reduces the risk of interference with other components of the multiplex signal.

In accordance with a further characteristic feature of the invention, an even further reduction of the risk of disturbances in existing receivers, in particular in the case of monophonic reception, can be achieved in that in each of the two halves of said frequency range, which is bisected by the stereo pilot, there is situated a subcarrier wave which is binary phase-modulated with the code signal, and that the two subcarrier waves which are modulated with the code signal have equal amplitudes and such a phase relative to the stereo pilot that together with the stereo pilot they constitute a signal which is obtained by quadrature modulation of the stereo pilot with an intercarrier wave which is derived from the stereo pilot, which intercarrier wave in its turn is binary phase-modulated with the code signal.

In the case of such a signal, each of the binary phase-modulated subcarrier signals may be regarded as a sideband of a double-sideband signal with the stereo pilot as the carrier wave. The stereo pilot is then quadrature-modulated with a modulation signal which in its turn is binary phase-modulated with the code signal. The modulation signal then has a frequency equal to the difference between the frequency of the stereo pilot and of a subcarrier wave. In addition to the stereo pilot with a frequency $f_p$ of 19 KHz, a system in accordance with this further characteristic feature of the invention which has been tested in practice has a first subcarrier wave of 16.625 KHz ($\frac{7}{8}$ $f_p$) which is binary phase-modulated with the code signal and a second subcarrier wave of 21.375 KHz (9/8 $f_p$) which is binary phase-modulated with the code signal. In the case of equal amplitudes of the two subcarrier waves and the correct phase relationship of the subcarrier waves and the stereo pilot, relative to each other, the three signals together constitute a stereo pilot which is quadrature-modulated with a intercarrier-wave signal of $\frac{1}{8}$ $f_p$ which in its turn is binary phase-modulated with the code signal. For this purpose the phase of the one subcarrier wave should lead the 90°-shifted stereo pilot by the same amount as the other subcarrier wave lags the 90°-shifted stereo pilot, in other words the resultant of the two modulated subcarrier waves exhibits a 90° phase shift relative to the stereo pilot.

The total of the stereo pilot and the two subcarrier waves constitutes a pilot signal whose amplitude is substantially constant. Since it is especially the amplitude variations of the pilot which give rise to distortion products as a result of the non-linear phase characteristic of the intermediate-frequency section of the receivers, the step described in the foregoing yields an additional distortion reduction.

Within the scope of the invention it is also possible to give the two subcarrier waves which are modulated with the code signal such a phase, that their resultant always coincides (0° or 180°) with the stereo pilot. The two subcarrier waves which function as sidebands of the stereo pilot then cause an amplitude modulation of the stereo pilot with a carrier signal which in its turn is binary phase-modulated with the code signal.

When the stereo pilot, double sideband-quadrature or amplitude-modulated by the two subcarrier waves or single-sideband phase and amplitude-modulated by the one subcarrier wave, is applied to the stereo decoder of a broadcast receiver, the stereo pilot filter which is already available in such receivers suppresses the already low subcarrier amplitudes so far relative to the stereo pilot itself, that disturbance of the stereo detection is substantially avoided. Such a disturbance would be substantially greater in the case of direct phase or amplitude-modulation of the stereo pilot with the code signal.

Obviously this disturbance also increases as the subcarrier waves are situated nearer the stereo pilot (for example at 11/12 $f_p$ and/or 13/12 $f_p$). Conversely, in the case of too large a subcarrier/stereo pilot distance the subcarrier wave will be situated too closely to the frequency spectrum of the audio information signal or of the modulated stereo information signal. For these reasons a distance of $\frac{1}{8}$ $f_p$ between the subcarrier wave (or carrier waves respectively) and the stereo pilot is to be preferred.

The invention also relates to a transmitter for the generation of a transmitter signal in accordance with the described system as well as a receiver for the reception and the processing of such a signal.

The receiver may then be adapted in accordance with one of the embodiments described in the cited previous U.S. application Ser. No. 878,666, in which case the divisions of the frequency dividers which are used should of course be adapted accordingly. As in the system in accordance with the present invention wherein the subcarrier frequency is situated relatively closely to that of the stereo pilot, it is preferred to mix the modulated subcarrier wave ($\frac{7}{8}$ $f_p$ and/or 9/8 $f_p$) firstly with the stereo pilot so as to obtain an intercarrier frequency ($\frac{1}{8}$ $f_p$) which is harmonically related to the stereo pilot, which intercarrier frequency is equal to the difference between the subcarrier frequency and stereo pilot frequency. Synchronous detection of the code signal can then be effected at this lower frequency in a similar way as described in the previous cited application Ser. No. 878,666.

DESCRIPTION OF THE DRAWINGS

The invention will be described in more detail with reference to the Figures given in the drawings. Of these Figures.

DESCRIPTION OF THE PREFERRED EMBODIMENTS

Figure 1:
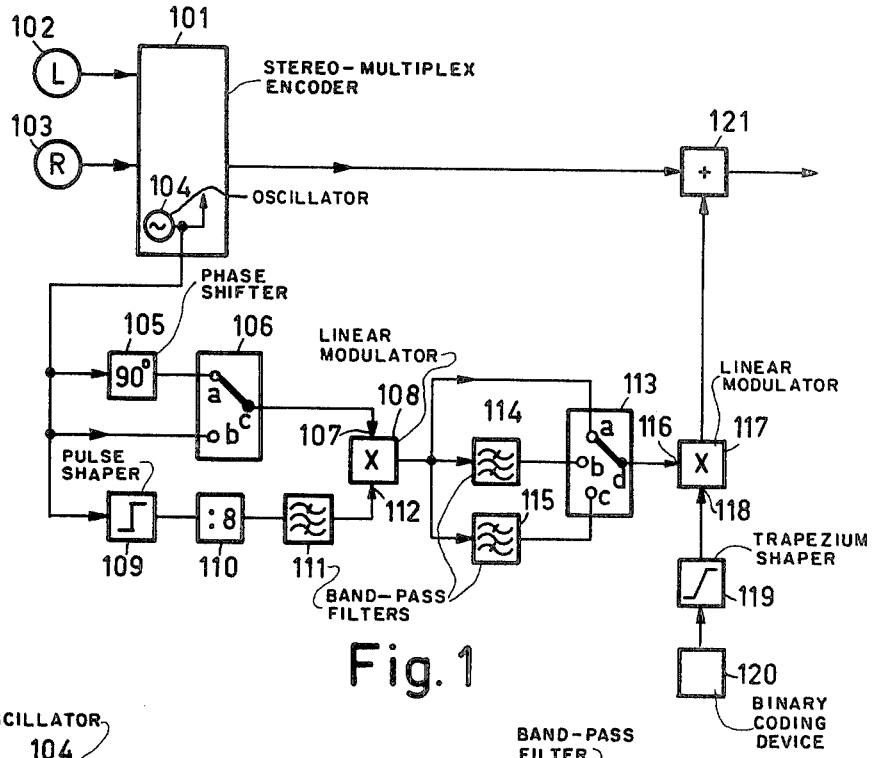
FIG. 1 and FIG. 1*a* respectively show a block diagram of a transmitter for the system in accordance with the invention.

The transmitter of FIG. 1 comprises a stereo-multiplex encoder 101 to which sources 102 and 103 of the left-hand and the right-hand audio signals, respectively, are connected, and which comprises a 19 KHz oscillator 104 which supplies a stereo pilot $f_p$. The encoder 101, in a known manner, composes a standard multiplex signal from the applied signals, which standard multiplex signal contains the audio frequency sum signal L+R, the L−R stereo information signal which is modulated on a suppressed carrier wave of 2 times the pilot frequency, along with the stereo pilot $f_p$ itself. It is assumed that the stereo pilot $f_p$ obtained from the oscillator 104 has the same phase as the pilot in the multiplex signal.

The stereo pilot $f_p$ is applied via a 90° phase shifter 105 to a first contact a and moreover directly to a second contact b of a switch 106. The master contact c of the switch 106 is connected to a first input 107 of a linear modulator 108. In the shown position of the switch 106, a stereo pilot which is 90° shifted relative to the stereo pilot $f_p$ in the multiplex signal is thus applied to the input 107 of the modulator 108. In the other position of the switch 106, the input 107 of the modulator 108 receives the stereo pilot $f_p$ in phase with that in the multiplex signal.

Moreover, the stereo pilot $f_p$ is applied to a frequency divider 110 via a pulse shaper 109, which divider 110 supplies a squarewave of $\frac{1}{8}$ times the stereo pilot frequency (2.375 KHz). A band-pass filter 111, which is tuned to this frequency, extracts the fundamental frequency therefrom, so that a sine wave of $\frac{1}{8}$ times the pilot frequency is available at the second input 112 of the modulator 108.

The modulator 108 is a linear balanced modulator wich produces the sum and difference frequencies ($f_p-f_p/8$ and $f_p+f_p/8$) of the two sine wave signals applied to it, while the originally applied frequencies ($f_p$ and $f_p/8$) are not contained in the output signal.

The output signal of the modulator 108 is subsequently applied directly to a first contact a of a three-position switch 113, via a band-passe filter 114, which is tuned to 16.625 KHz ($\frac{7}{8}$ $f_p$), to a second contact b of the switch 113, and via a band-pass filter 115, which is tuned to 21.375 KHz (9/8 $f_p$), to a third contact c of the three-position switch 113. The master contact d of the three-position switch 113 is connected to a first input 116 of a linear balanced modulator 117. A binary coding device 120 is connected to the second input 118 of said modulator 117 via a trapezium-shaper 119, which device 120 supplies a binary code signal in which the transmitter identification information is contained. The trapezium-shaper 119 reduces the content of higher frequency components in the binary code signal, so that the code signal, as applied to the modulator 117, occupies a limited frequency range (up to approximately 600 Hz).

In the third position (c) of the switch 113, the subcarrier wave of 9/8 $f_p$ ($f_p+\frac{1}{8}f_p$), which is transferred via the filter 115, is binary phase-modulated with the code signal from the device 120 in the modulator 117, while in the second position (b) of the switch 113 the subcarrier wave of $\frac{7}{8}f_p$ ($f_p-\frac{1}{8}f_p$), transferred via the filter 114, is binary phase-modulated with the code signal. In the first position (a) of the switch 113, the two combined subcarrier waves ($\frac{7}{8}f_p$ and 9/8 $f_p$) from the modulator 108 are binary phase-modulated with the code signal. The output signal of the modulator 117 is finally added to the stereo multiplex signal from the encoder 101 in an adder stage 121, in such a way that the amplitude of the added subcarrier wave (or subcarrier waves) is substantially smaller (for example 30 times) than the amplitude of the stereo pilot $f_p$ present in the multiplex signal. The output signal of the adder stage 121 is finally applied to an FM transmitter (not shown).

In position (a) of the two switches 106 and 113, the complete transmitted signal, in addition to the stereo pilot $f_p$, contains the subcarrier waves $f_p+\frac{1}{8}f_p$ and $f_p-\frac{1}{8}f_p$, which are both binary phase-modulated with the code signal. The resultant of the two subcarrier waves is then always 90° shifted relative to the stereo pilot, in such a way that the stereo pilot with the two subcarrier waves as sidebands constitutes a signal which is quadrature-modulated, i.e. only slightly amplitude-modulated. The modulating signal itself is then a carrier wave of $\frac{1}{8}f_p$ which is binary phase-modulated with the code signal. In the second position (b) of the switch 106 the resultant of the two subcarrier waves is in phase (or 180° out-of-phase) with the stereo pilot $f_p$, so that the stereo pilot $f_p$, with the two subcarrier waves as sidebands, constitutes a signal which is amplitude-modulated and not phase-modulated with the modulated $\frac{1}{8}f_p$ signal.

In the second and the third position of the switch 113 only the lower or the upper sideband is respectively added to the stereo pilot of the multiplex signal. Changing over the switch 106 results in a 90° phase shift of the single sideband relative to the stereo pilot, but this is of little practical interest.

Figure 1A:
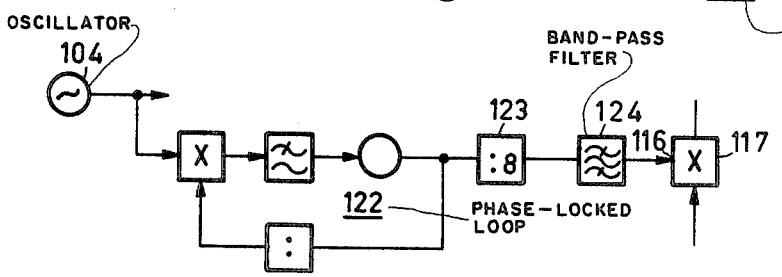

It will be evident that the diagram of FIG. 1 relates to an experimental transmitter which is suitable for testing which system will perform best in practice. In the definitive version, a transmitter, need only be suitable for one system and can thus be of simpler design. For example a transmitter in which only one modulated subcarrier of, for example, $\frac{7}{8}f_p$ or 9/8 $f_p$ is added to the multiplex signal (see FIG. 1*a*), may contain a phase-locked loop 122 which derives a signal of $7f_p$ or $9f_p$ from the stereo pilot, followed by a divide-by-8 divider 123 for providing a pulse-shaped signal of $\frac{7}{8}f_p$ or 9/8 $f_p$, and then a band-pass filter 124 for shaping the pulse-shaped signal into a sinewave signal of $\frac{7}{8}f_p$ or 9/8 $f_p$, said sinewave signal then being applied to the first input 116 of the modulator 117.

In a definitive transmitter for a system with two modulated subcarrier waves, the elements 106, 113, 114, 115 of FIG. 1 may be eliminated. The oscillator 104 may then be connected to the first input 107 of the modulator 108 either directly or via the phase-shifter 105, and the output of 108 may be connected directly to the first input 116 of the modulator 117. Instead of first mixing the stereo pilot $f_p$ with the $f_p/8$ signal and subsequently modulating the result with the code signal, it is also possible to modulate the $f_p/8$ signal first with the code signal and to mix it subsequently with the stereo pilot $f_p$ or to modulate the stereo pilot $f_p$ with the code signal and to mix it subsequently with the $f_p/8$ signal.

Figure 2:
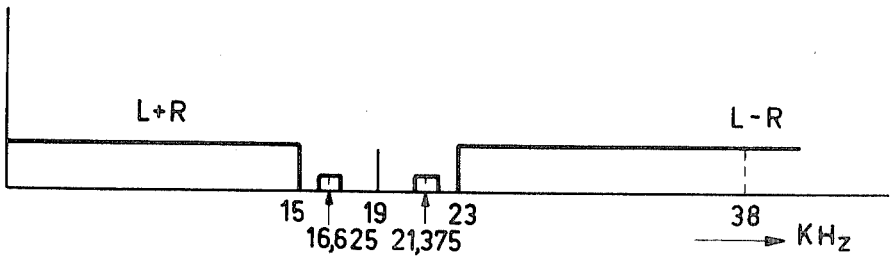
FIG. 2 shows the frequency spectrum of a multiplex signal which in the system in accordance with the invention is generated on the transmission side and is obtained on the reception side after FM demodulation.

FIG. 2 shows the frequency spectrum of the signal supplied by the adder stage 121. The Figure shows the audio-frequency information signal from 0 to 15 KHz, the stereo pilot $f_p$ at 19 KHz, the stereo information signal, which is modulated on 38 KHz, from 23 KHz to 53 KHz (not shown), and at 16.625 and 21.375 KHz, the two binary phase-modulated subcarrier waves, each having a bandwidth of approximately 1200 Hz. It is to be noted that the amplitudes of the signal components differ considerably more from each other than is shown in the FIG. 2 which is shown as such for the sake of clarity. In practice, the L+R and L−R signal components may be 9 times greater than the stereo pilot $f_p$ while the two subcarrier signals may, for example, be 30 times smaller than the stereo pilot $f_p$.

Figure 3:
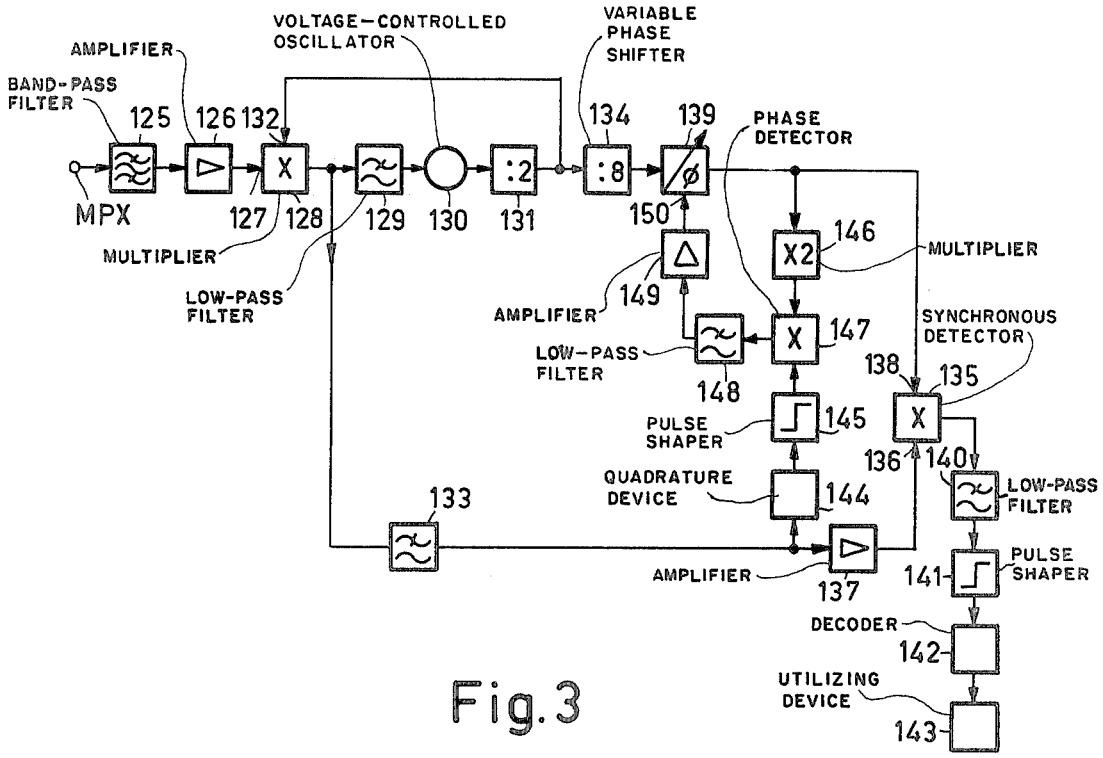
FIG. 3 shows a block diagram of a first embodiment of a receiver in accordance with the invention.

The receiver of FIG. 3 is especially suitable for a system in which only one binary phase-modulated subcarrier wave is transmitted at, for example, $\frac{7}{8}f_p$ (16.625 KHz). In FIG. 3 the usual receiver elements such as high-frequency, intermediate frequency, and low-frequency stages are not shown. The multiplex signal obtained from the frequency discriminator of the receiver is applied to a band-pass filter 125 which is tuned to the 16.625 KHz subcarrier frequency $\frac{7}{8}f_p$ and may have an effective quality factor of, for example, 15. This filter transfers the modulated subcarrier frequency as well as the stereo pilot $f_p$ itself which, though situated on the filter slope, is still substantially greater than the subcarrier signal. After amplification in an amplifier 126, the two signals are applied to a first input 127 of a multiplier stage 128 which has two functions.

First of all, the stage 128 functions as a phase detector in a phase-locked loop which furthermore includes a low-pass filter 129, a voltage-controlled 38-KHz oscillator 130, and a divide-by-two divider 131, which divider feeds a 19-KHz squarewave back to a second input 132 of the multiplier stage 128. This phase-locked loop locks in to the received stereo pilot $f_p$ and consequently provides a 19 KHz squarewave at the output of the divider 131 which is synchronized with the received stereo pilot $f_p$. The low-pass filter 129, which serves to prevent the phase-locked loop from being influenced by signal components other than the stereo pilot, may have a cut-off frequency of, for example, 300 Hz and a frequency roll-down of 6 dB/octave above said cut-off frequency.

Secondly, the multiplier stage 128 functions as mixing stage for the modulated 16.625 KHz ($\frac{7}{8}f_p$) subcarrier wave. This sub-carrier wave is mixed with the 19 KHz ($f_p$) squarewave at the input 132 and this yields a binary phase-modulated intercarrier frequency signal of 2.375 KHz ($\frac{1}{8}f_p$), which is transferred via a low-pass filter 133 with a cut-off frequency of, for example, 3 KHz and a high-frequency roll-down of 20 dB/octave.

Instead of a voltage-controlled 19 KHz oscillator, a voltage-controlled 38 KHz oscillator 130 followed by a divide-by-two divider 131 is used, because a divide-by-two circuit provides a more symmetrical squarewave than a voltage-controlled oscillator. Thus, the stage 128 is driven by a purely symmetrical squarewave, so that input signal components around the even harmonics of 19 KHz, in particular around 38 KHz, have no influence on the output signal of the stage 128. Detection of signal components around 57 KHz by the stage 128 is adequately prevented by the filter 125, which provides sufficient attenuation for these signal components.

Thus, with the aid of the elements 128, 129, 130 and 131, a filtered stereo pilot is available at the output of the divide-by-two divider 131 and a converted subcarrier wave at the output of the stage 128. However, it will be evident that these functions can also be performed by any suitable filter and converter device.

In a divide-by-eight divider 134, the 19 kHz squarewave from the divide-by-two divider 131 is divided so as to obtain a squarewave with a frequency of 2.375 KHz ($\frac{1}{8}$ $f_p$). Consequently, a binary phase-modulated 2.375 KHz carrier signal is available at the output of the filter 133 and an unmodulated 2.375 KHz squarewave, derived from the stereo pilot, at the output of the divider 134. The modulated carrier signal can now be synchronously demodulated with the aid of the unmodulated wave and be processed in accordance with one of the methods as described in the previous cited U.S. application Ser. No. 878,666. Actual detection is effected in a synchronous detector 135 to wherein the modulated signal from the filter 133 is applied to a first input 136 thereof via an amplifier 137, while the unmodulated wave from the divider 134 is applied to a second input 138 thereof via a variable phase shifter 139. The detected code signals are filtered in a low-pass filter 140 with a cut-off frequency of, for example 350 Hz and a high-frequency roll-down of 20 dB/octave, and are subsequently converted into squarewave pulses with the aid of a pulse shaper 141. The squarewave pulses are then applied to a decoder 142, which converts the squarewave pulses, which form in essence the binary transmitter identification signal into signals which are suitable for application to a utilizing device 143. The utilizing device 143 may be different, depending on the information contained in the code. If the code contains information about the received station and/or the received programming, the device 143 may comprise a display which displays said information so that, for example, the usual tuning scale may be dispensed with. It is alternatively possible that the device 143 comprises an automatic station search circuit in such a way that the receiver only tunes into those stations which broadcast a specific type of programming, for example, classical music. Under these conditions, the code contains time information the device 143 may, for example, turn on or off a tape recorder connected to it at a specific preset time. If the code is a paging signal, the device 143 is constituted by a receiver for such paging signal.

The phase shifter 139 serves to eliminate any phase errors which may arise between the modulated 2.375 KHz signal and the unmodulated 2.375 KHz squarewave. These phase errors may arise at the divider 110 in the transmitter and the divider 134 in the receiver and as a result of differences in transit time in the various filters, for example, in the filter 125. For said phase control, the binary phase-modulated 2.375 KHz signal is converted into a 4.75 KHz squarewave with the aid of a quadrature device 144 and a pulse shaper 145. In addition, the unmodulated wave from the phase shifter 139 is converted into a 4.75 KHz squarewave with the aid of a frequency multiplier 146. The two 4.75 KHz squarewaves are compared with each other, in phase detector 147 which in a response thereto, produces a control signal which, after filtering in a low-pass filter 148 and amplification in an amplifier 149, is applied to the control input 150 of the variable phase shifter 139. The phase shifter 139 thus ensures that the 2.375 KHz squarewave and the 2.375 KHz signal which are applied to the synchronous detector 135 are in phase (or 180° out-of-phase). The phase ambiguity which may then still occur may, for example, be avoided by the use of a (differential) code which is insensitive thereto, the bits being characterized by the presence or absence of a transient in the signal.

The phase shifter 139 may, for example, consist of two cascaded monostable circuits, the time constant of the first circuit being controlled by the aforementioned control circuit and that of the second being equal to half a period of the signal to be delayed while the first monostable circuit is started by the incoming signal and the second circuit by the trailing edge of the output of the first circuit. Such a phase shifter is capable of shifting the phase of the signal through substantially 360°, which amply suffices because the signal need only be shifted through 180°. If the phase shifter were included in a branch where twice the frequency to be demodulated occurs, a phase shifter would be needed which would be capable of shifting the phase through a full 360° period.

A preferred embodiment of a receiver for the reception of signals which contain two binary phase-modulated subcarrier waves, one on either side of the stereo pilot $f_p$, the stereo pilot $f_p$ being quadrature-modulated as a result of the two subcarrier waves, may be of the same design as that shown in FIG. 3, with the proviso that the filter 125, instead of being tuned to one subcarrier wave, is tuned to the stereo pilot $f_p$, with the pass-band of the filter sufficiently wide to transmit the two subcarrier waves. On the other hand, the attenuation outside the pass-band, in particular for signals round 57 KHz, should be sufficient to avoid interference.

Figure 4:
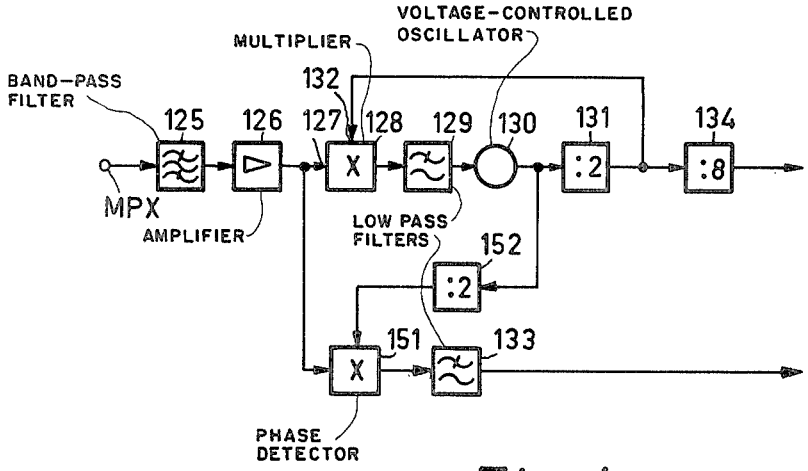
FIG. 4 shows a block diagram of a second embodiment of a receiver in accordance with the invention.

In a receiver for the reception of signals with a binary phase-modulated subcarrier wave on both sides of the stereo pilot, $f_p$ the resultant of the two subcarrier waves being in phase with the stereo pilot $f_p$, it is no longer possible to employ the phase detector 128 of the phase-locked loop also for down-conversion of the signal, because the phase detector and the mixing stage should then be controlled by stereo pilots which are 90° phase shifted relative to each other. FIG. 4 shows a possible embodiment for such a receiver, in which corresponding elements bear the same reference numerals as in FIG. 3.

The output signal of the amplifier 126 is then applied both to the phase detector 128 and to a second detector 151 which functions as a mixing stage. In this detector 151 the input signal is mixed with a 19 KHz squarewave which via frequency division by a divide-by-two divider 152 is derived from the 38 KHz oscillator 130. The two divide-by-two dividers 131 and 152 are controlled in such a way that they supply 19 KHz waves which are 90° phase shifted relative to each other.

We claim:

1. A transmitter for a radio broadcasting system with code signalling said transmitter, comprising means for generating an audio frequency information signal, a modulator for modulating a stereo information signal on a suppressed stereo subcarrier wave, an oscillator for generating a stereo pilot having a frequency situated in the frequency range between the upper limit of the frequency spectrum of said audio frequency information signal and the lower limit of the frequency spectrum of said modulated stereo information signal, a source of binary code signals, and a modulating signal generator, connected to said source of binary code signals and to said oscillator, for generating a further subcarrier wave which is binary phase-modulated with the code signals, said further subcarrier wave being a harmonic of a subharmonic of the stereo pilot and being situated in at least one of the two halves of said frequency range, said two halves being defined by said stereo pilot.

2. A transmitter as claimed in claim 1, wherein the modulating signal generator comprises a subcarrier wave generator for generating said further subcarrier wave, and a modulator which is connected to the subcarrier wave generator and to the source of binary code signals, for the binary phase modulation of the further subcarrier wave with the code signals.

3. A transmitter as claimed in claim 1 wherein the modulating signal generator comprises a frequency composer connected to the oscillator, for the generation of an intercarrier wave with a frequency equal to the frequency distance between the further subcarrier wave and the stereo pilot, and a first and a second modulator each provided with a first and a second input and an output, the output of the first modulator being connected to the first input of the second modulator, the first input of the first modulator being connected to the oscillator and the second input of the first modulator being connected to the frequency composer, and a second input of the second modulator being connected to the source of binary code signals.

4. A transmitter as claimed in claim 3, wherein said first modulator is a linear balanced modulator which generates, along with said further subcarrier wave, a second further subcarrier wave, said second further subcarrier wave being located on the opposite side of, and equidistant from, the stereo pilot frequency as said other further subcarrier wave, whereby, in said second modulator, said binary code signals are modulated on both said further subcarrier wave and said second further subcarrier wave.

5. A transmitter as claimed in claim 4, wherein said two further subcarrier waves, which are modulated with the binary code signals, have equal amplitudes and such a phase relative to the stereo pilot that, together with the stereo pilot, the two further subcarrier waves constitute a signal which is quadrature-modulated, which signal is binary phase-modulated with the binary code signals.

6. A transmitter as claimed in claim 3, wherein said frequency distance between said further subcarrier wave and said stereo pilot is equal to one-eighth times the stereo pilot frequency.

7. A receiver for a radio broadcasting system with code signalling which uses a transmitter as claimed in any one of the claims 1–6, said receiver comprising a frequency discriminator for the demodulation of the received main carrier; a circuit coupled to the output of the frequency discriminator, for filtering the stereo pilot and for converting, with the aid of the filtered stereo pilot, the further subcarrier wave, which is binary phase-modulated with the code signal, into a binary phase-modulated intercarrier signal having a frequency equal to the frequency distance between the further subcarrier wave and the stereo pilot; a synchronous demodulator having a first and a second input and an output; a first transmission path which is connected to said circuit for the application of the modulated intercarrier wave to the first input of the synchronous demodulator; a second transmission path, connected to said circuit, and including at least one frequency divider for the generation of an unmodulated intercarrier wave from the filtered stereo pilot and for the application of the unmodulated intercarrier wave to the second input of the synchronous demodulator; and an output circuit for the demodulated code signal, which output circuit is coupled to the output of the synchronous demodulator.

8. A receiver as claimed in claim 7, wherein said circuit comprises a phase-locked loop for generating a signal synchronous to the stereo pilot, which loop includes a voltage-controlled oscillator, a filter, and a phase detector having a first and a second input and an output, the output signal of the frequency discriminator being applied to the first input of the phase detector, the synchronous signal, from the voltage-controlled oscillator, being applied to the second input of the phase detector, and said first transmission path connected to the output of the phase detector, the phase detector of the phase-locked loop converting the modulated subcarrier wave into said modulated further intercarrier signal.

9. A receiver as claimed in claim 7, which further comprises a band-pass filter between the output of the frequency discriminator and the input of said circuit, said band-pass filter being tuned to the subcarrier wave which has been modulated with the code signal, the stereo pilot being transmitted on a slope of said filter.

* * * * *